US008690530B2

(12) United States Patent
Snook et al.

(10) Patent No.: US 8,690,530 B2
(45) Date of Patent: Apr. 8, 2014

(54) SYSTEM AND METHOD FOR SUPPORTING A NOZZLE ASSEMBLY

(75) Inventors: Daniel David Snook, Moore, SC (US); Leissner Ferdinand Poth, III, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 525 days.

(21) Appl. No.: 13/169,415

(22) Filed: Jun. 27, 2011

(65) Prior Publication Data

US 2012/0328413 A1 Dec. 27, 2012

(51) Int. Cl.
*F01D 9/02* (2006.01)

(52) U.S. Cl.
USPC ..... 415/209.3

(58) Field of Classification Search
CPC ..... F04D 25/246; F04D 9/042; F01D 25/246; F01D 9/042
USPC ..... 415/209.2, 209.3
See application file for complete search history.

(56) References Cited

U.S. PATENT DOCUMENTS

| | | | | |
|---|---|---|---|---|
| 3,558,237 | A | 1/1971 | Wall, Jr. | |
| 4,163,629 | A | 8/1979 | McDonough et al. | |
| 4,802,823 | A | 2/1989 | Decko et al. | |
| 4,979,872 | A * | 12/1990 | Myers et al. | 415/142 |
| 5,160,251 | A * | 11/1992 | Ciokajlo | 415/142 |
| 6,398,485 | B1 * | 6/2002 | Frosini et al. | 415/115 |
| 6,971,847 | B2 * | 12/2005 | Tiemann | 415/209.2 |
| 7,114,917 | B2 | 10/2006 | Legg | |
| 7,824,152 | B2 | 11/2010 | Morrison | |

* cited by examiner

*Primary Examiner* — Ninh H Nguyen
(74) *Attorney, Agent, or Firm* — Dority & Manning, P.A.

(57) ABSTRACT

A system for supporting a nozzle assembly includes a first member connected to a stationary component and a second member extending from the first member radially through at least a portion of the nozzle assembly. A distal end of the second member is radially displaced from the first member and configured to contact the nozzle assembly. A method for supporting a nozzle assembly includes connecting a first member to a stationary component and extending a second member from the first member radially through at least a portion of the nozzle assembly. The method further includes contacting a distal end of the second member to the nozzle assembly, wherein the distal end is radially displaced from the first member.

16 Claims, 4 Drawing Sheets

SYSTEM AND METHOD FOR SUPPORTING A NOZZLE ASSEMBLY

FIELD OF THE INVENTION

The present invention generally involves a system and method for supporting a nozzle assembly. In particular embodiments of the present invention, a support extends radially through a portion of the nozzle assembly to reduce the effects of creep in the nozzle assembly.

BACKGROUND OF THE INVENTION

Nozzle assemblies, also referred to as stators or stator assemblies, are commonly included in various forms of commercial equipment. For example, compressors and turbines generally include alternating stages of nozzle assemblies and rotating blades as is known in the art. Each nozzle assembly generally comprises one or more airfoils connected to an outer sidewall and an inner sidewall. The outer sidewall is typically fixedly attached to a stationary component, such as a shroud or casing, and the inner sidewall is typically proximate to one or more rotating components, such as a rotor or rotor wheel. In this manner, the outer sidewall provides a cantilevered support for the nozzle assembly, with the airfoils extending radially inward substantially perpendicular to a fluid flow to direct the fluid flow onto a downstream stage of rotating blades or buckets.

Over time, the fluid flow over the nozzle assemblies may plastically deform the shape and/or profile of the nozzle assemblies, a condition also known as "creep." The effects of creep is one of the main failure mechanisms in a gas turbine having cantilevered nozzle assemblies. Specifically, over time the fluid flow over the nozzle assemblies causes the inner sidewall to move in the direction of the fluid flow. Deflection of the inner sidewall may reduce the clearance between the inner sidewall and the rotating components, restricting cooling flow between the inner sidewall and the rotating components. The reduced cooling flow between the inner sidewall and the rotating components may lead to excessive temperatures and ultimately failure of the rotating components. In addition, excessive creep may cause the stationary nozzle assemblies to crack and/or deflect into the rotating components, causing substantial damage and requiring costly repairs to both the stationary nozzle assemblies and the rotating components. As a result, the axial length of the nozzle assemblies may be required to increase in order to reduce the amount or effect of creep that occurs in the nozzle assemblies over the expected life, resulting in a corresponding increase in the length of the compressor or turbine.

Various systems and methods are known in the art for reducing or preventing the effects of creep in nozzle assemblies. For example, superalloys that are more resistant to the effects of creep may be used in the manufacture of the airfoils and/or sidewalls of the nozzle assemblies. Alternately, or in addition, the shape and/or thickness of the airfoil and/or sidewalls may be increased to reduce the amount of creep that occurs over time. Lastly, a cooling medium may be supplied inside the airfoil to reduce the surface temperature of the nozzle assemblies to reduce creep. Although these systems and methods have proven effective at reducing the effects of creep, the cost to implement these systems and methods may be substantial. Therefore, an improved system and method for supporting nozzle assemblies to reduce the effects of creep would be useful.

BRIEF DESCRIPTION OF THE INVENTION

Aspects and advantages of the invention are set forth below in the following description, or may be obvious from the description, or may be learned through practice of the invention.

One embodiment of the present invention is a system for supporting a nozzle assembly that includes a first member connected to a stationary component and a second member extending from the first member radially through at least a portion of the nozzle assembly. A distal end of the second member is radially displaced from the first member and configured to contact the nozzle assembly.

Another embodiment of the present invention is a system for supporting a nozzle assembly that includes a support, wherein at least a portion of the support extends radially through at least a portion of the nozzle assembly and contacts the nozzle assembly. The system further includes means for connecting at least a portion of the support to a stationary component proximate to the nozzle assembly.

The present invention may also include a method for supporting a nozzle assembly. The method includes connecting a first member to a stationary component and extending a second member from the first member radially through at least a portion of the nozzle assembly. The method further includes contacting a distal end of the second member to the nozzle assembly, wherein the distal end is radially displaced from the first member.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
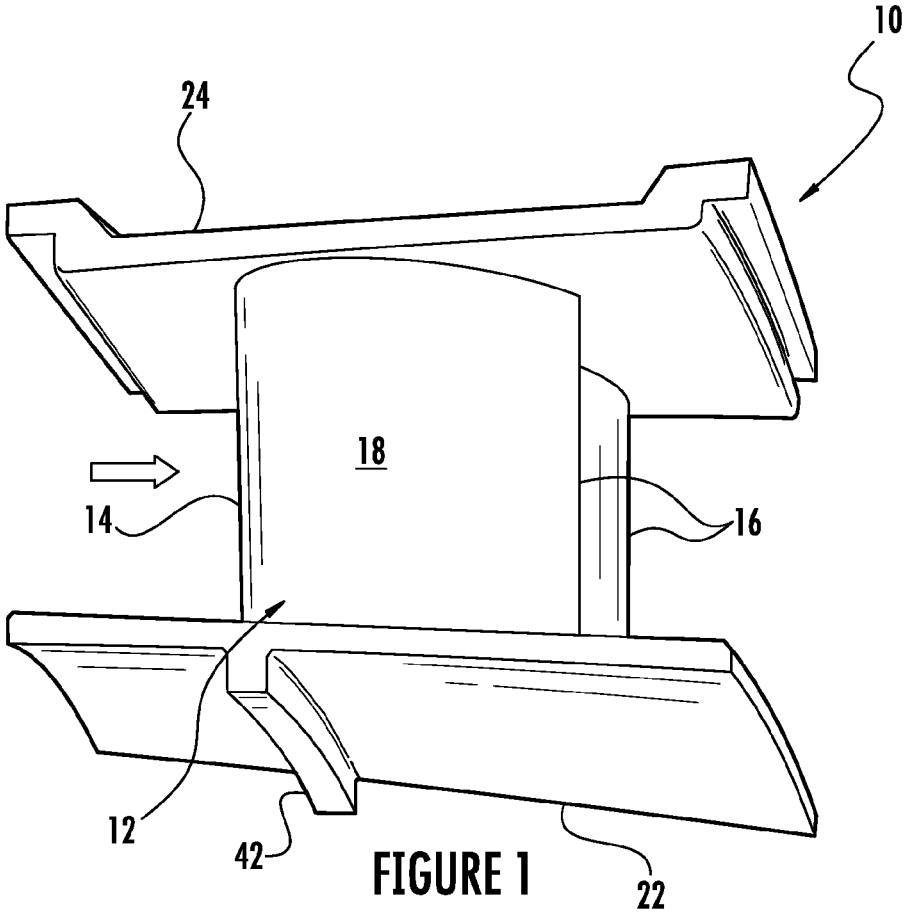
FIG. 1 is a perspective view of an exemplary nozzle.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Various embodiments of the present invention provide an improved system and method for supporting a nozzle assembly. In particular embodiments, a support connected to one or more stationary components extends radially inside at least a portion of the nozzle assembly and connects to the nozzle assembly. By extending the support inside the nozzle assembly, the support may be thermally isolated from the high temperatures associated with fluid flow through a hot gas path. In addition, by extending the support inside the nozzle assembly, the shape of the support is not required to be aerodynamic and may instead comprise a shape more ideally suited for mechanically reinforcing the nozzle assembly. The additional mechanical reinforcement provided by the support may thus allow less expensive materials to be used in the manufacture of the nozzle assembly, reduced cooling flow through the nozzle assembly, and/or larger nozzle assemblies.

FIG. 1 shows an exemplary nozzle assembly 10 that might be included for example in a compressor or a turbine to provide context for various embodiments of the present invention. As shown, the exemplary nozzle assembly 10 generally includes a pair of vanes 12, with each vane 12 having a leading edge 14, a trailing edge 16, a vacuum side 18, and a pressure side (not visible). The leading-edge 14 is typically rounded, and the trailing edge 16 is typically pointed. The vacuum side 18 typically has a convex curvature, and the pressure side typically has a concave curvature. The leading-edge 14, trailing edge 16, vacuum side 18, and pressure side combine to form an airfoil for each vane 12. As shown in FIG. 1, an inner sidewall 22 and an outer sidewall 24 may connect the pair of vanes 12 to form the nozzle assembly 10. The outer sidewall 24 is then typically fixedly connected to a stationary component, such a shroud or casing of a compressor or turbine, and the inner sidewall 22 is typically proximate to a rotating component, such as a rotor or rotor wheels. In this manner, a working fluid may flow from left to right as shown in FIG. 1 between the pair of vanes 12 and the inner and outer sidewalls 22, 24 to the downstream components.

Figure 2:
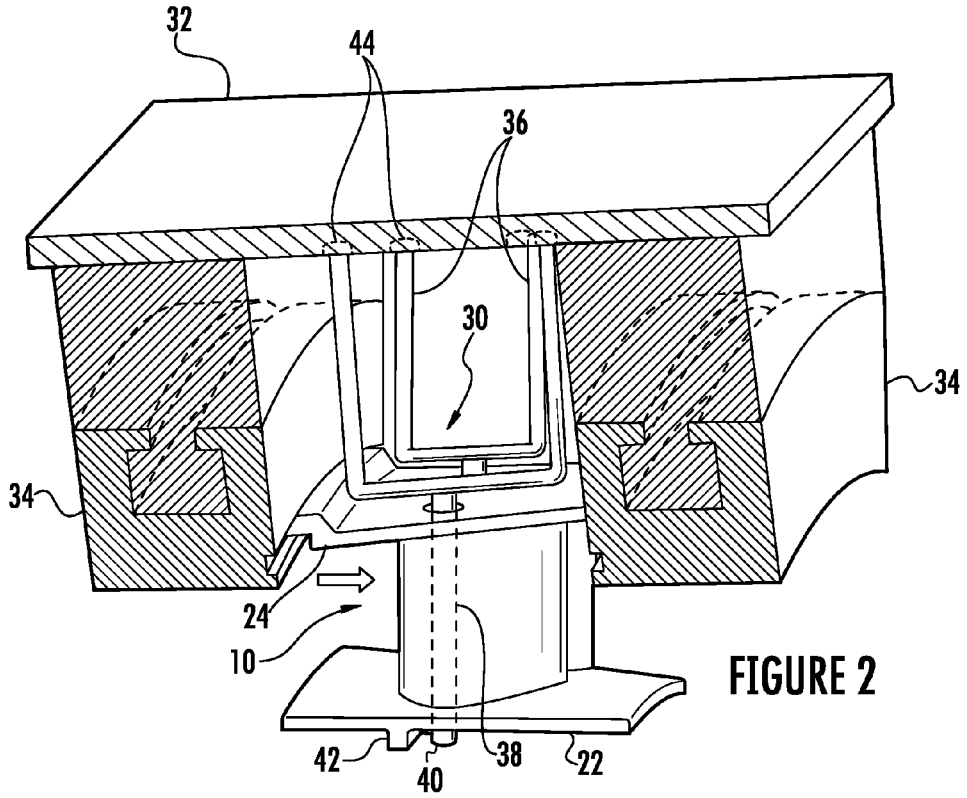
FIG. 2 is a perspective view of a system for supporting a nozzle assembly according to a first embodiment of the present invention.
Figure 3:
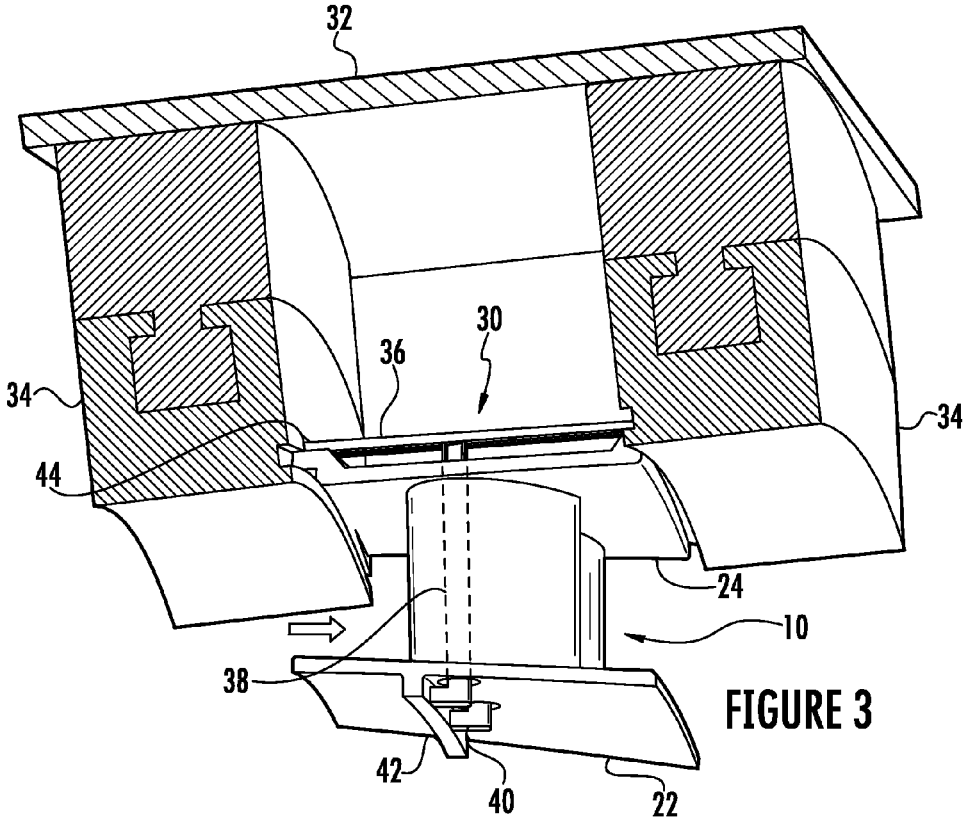
FIG. 3 is a perspective view of a system for supporting a nozzle assembly according to a second embodiment of the present invention.

FIGS. 2 and 3 provide perspective views of the system for supporting the nozzle assembly 10 shown in FIG. 1 according to first and second embodiments of the present invention. In each embodiment, the system generally comprises a support 30 connected to a stationary component proximate to the nozzle assembly 10. The stationery component may comprise, for example, a casing 32 that encloses the compressor or turbine, as shown in FIG. 2, or a shroud 34 that defines the outer perimeter of the hot gas path, as shown in FIG. 3. One of ordinary skill in the art can really appreciate that the stationary component may comprise virtually any structure that provides a suitable anchor for holding the support 30 firmly in place, and the present invention is not limited to any particular stationary component unless specifically recited in the claims.

The support 30 may comprise a plurality of segments formed from a superalloy or other material capable of providing the desired structural reinforcement to the nozzle assembly 10. For example, the support 30 may comprise a first member 36 and a second member 38, with the particular orientation or geometry of the first and second members 36, 38 dependent on the particular embodiment. For example, as shown in FIG. 2, the first and second members 36, 38 may be aligned approximately parallel to one another, with the first member 36 extending radially and fixedly connected to the casing 32 and the second member 38 extending inward from the first member 36 radially through at least a portion of the nozzle assembly 10. Alternately, as shown in FIG. 3, the first and second members 36, 38 may be aligned approximately perpendicular to one another, with the first member 36 extending axially and fixedly connected to the shroud 34 and the second member 38 again extending inward from the first member 36 radially through at least a portion of the nozzle assembly 10. As shown most clearly in FIG. 3, the second member 38 may include a distal end 40 radially displaced from the first member 36 and configured to contact the nozzle assembly 10. For example, as shown in FIGS. 2 and 3, the distal end 40 is configured to abut or contact a land 42 on the inner sidewall 22 of the nozzle assembly 10. In this manner, at least a portion of the support 30 extends radially through at least a portion of the nozzle assembly 10 and contacts the nozzle assembly 10. As the effects of creep tend to force the inner sidewall 22 of the nozzle assembly 10 to the right, as shown in FIGS. 2 and 3, the distal end 40 of the second member 38 inhibits or limits movement of the inner sidewall 22 by transferring the force through the support 30 to the stationary component.

As shown in FIGS. 2 and 3, the support 30 is located inside at least a portion of the nozzle assembly 10 and the space between the nozzle assembly 10 and the casing 32 and is therefore not exposed to the hot gas path of the fluid flow. As a result, the support 30 is effectively thermally isolated from the hot gas path and remains relatively unaffected by the higher temperatures associated with the hot gas path compared to the nozzle assembly 10. In addition, the shape of the support 30 is not required to be aerodynamic and may instead comprise a shape more ideally suited for mechanically reinforcing the nozzle assembly 10. For example, as shown in FIG. 2, the first and/or second members 36, 38 may comprise a tube or cylinder that resists the effects of creep much more effectively than the airfoil of the nozzle assembly 10. Alternately, as shown in FIG. 3, the first and/or second members 36, 38 may comprise a square or rectangular I-beam that is similarly better suited to resist the effects of creep compared to the airfoil of the nozzle assembly 10.

In each embodiment, the system may further include means for connecting at least a portion of the support 30 to the stationary component proximate to the nozzle assembly 10. The means may comprise any suitable structure or device for connecting one component to another. For example, the means may comprise a threaded engagement, and hasp, a clamp, or, as shown in FIGS. 2 and 3, a recess or indent 44 in the stationary component that securely holds the first member 36 of the support 30 in place and limits or restricts movement of the first member 36 with respect to the stationary component.

Figure 4:
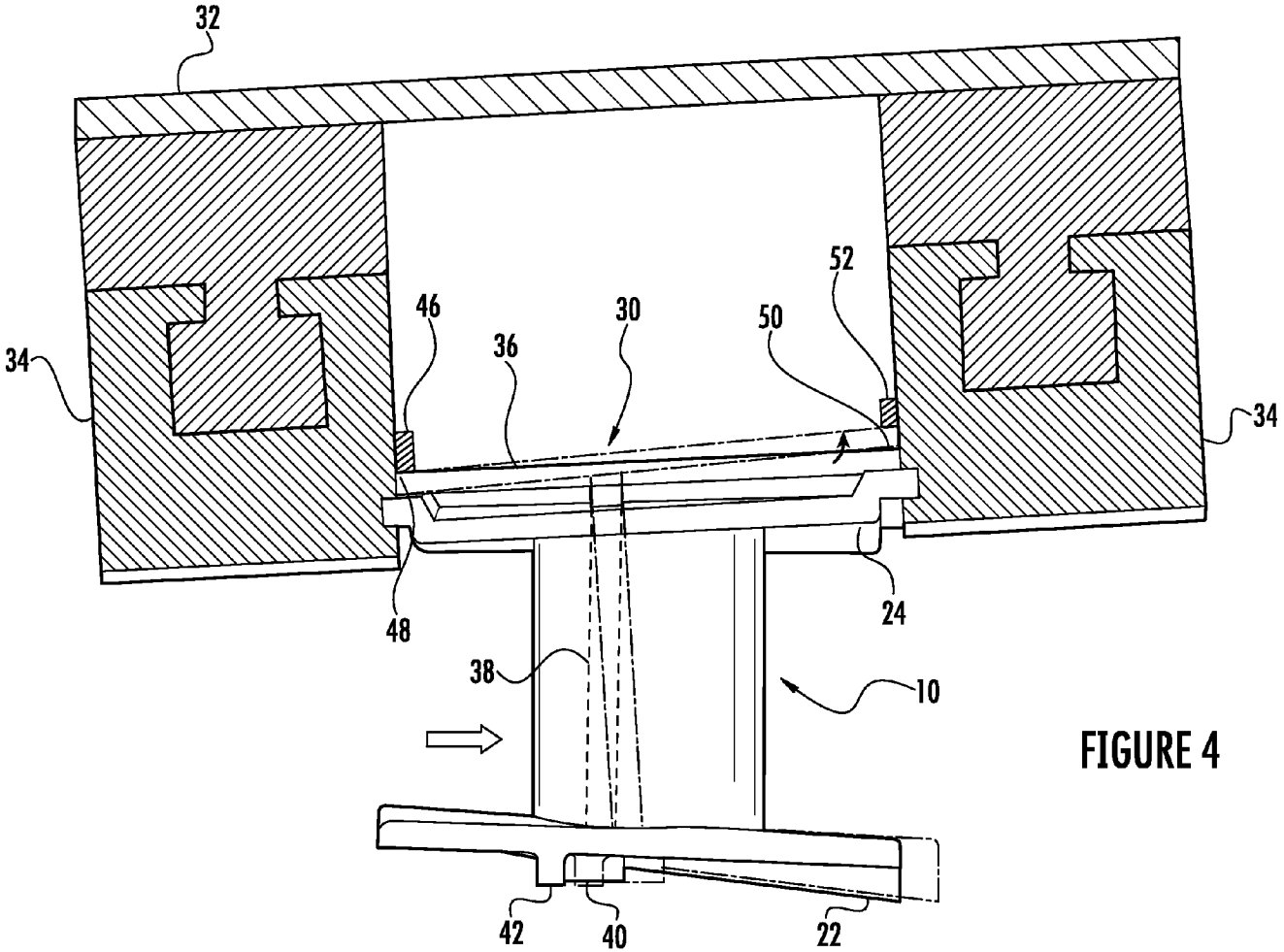
FIG. 4 is a side view of a system for supporting a nozzle assembly according to a third embodiment of the present invention.

FIG. 4 provides a side view of the system for supporting the nozzle assembly 10 shown in FIG. 1 according to an additional embodiment of the present invention. In this particular embodiment, the means for connecting at least a portion of the support 30 to the stationary component may comprise one or more detents or stops attached to the shroud 34 or other stationary component. For example, a first detent 46 may fixedly connect a first end 48 of the first member 36 to the shroud 34. A second end 50 of the first member 36 axially displaced from the first end 48 is slidingly engaged with the shroud 34 and may move with respect to the shroud 34, and a second detent 52 located proximate to the second end 50 limits movement of the second end 50 with respect to the shroud 34. As the effects of creep tend to force the inner sidewall 22 of the nozzle assembly 10 to the right, as shown in FIG. 4, the land 42 on the inner sidewall 22 of the nozzle assembly 10 forces the distal end 40 of the second member 38 to the right. As the distal end of 40 of the second member 38 moves to the right, the support 30 rotates counterclockwise until the second end 50 of the first member 36 abuts or contacts the second detent 52. The second detent 52 prevents or limits further movement of the support 30 which in turn prevents or limits further movement of the inner sidewall 22.

Figure 5:
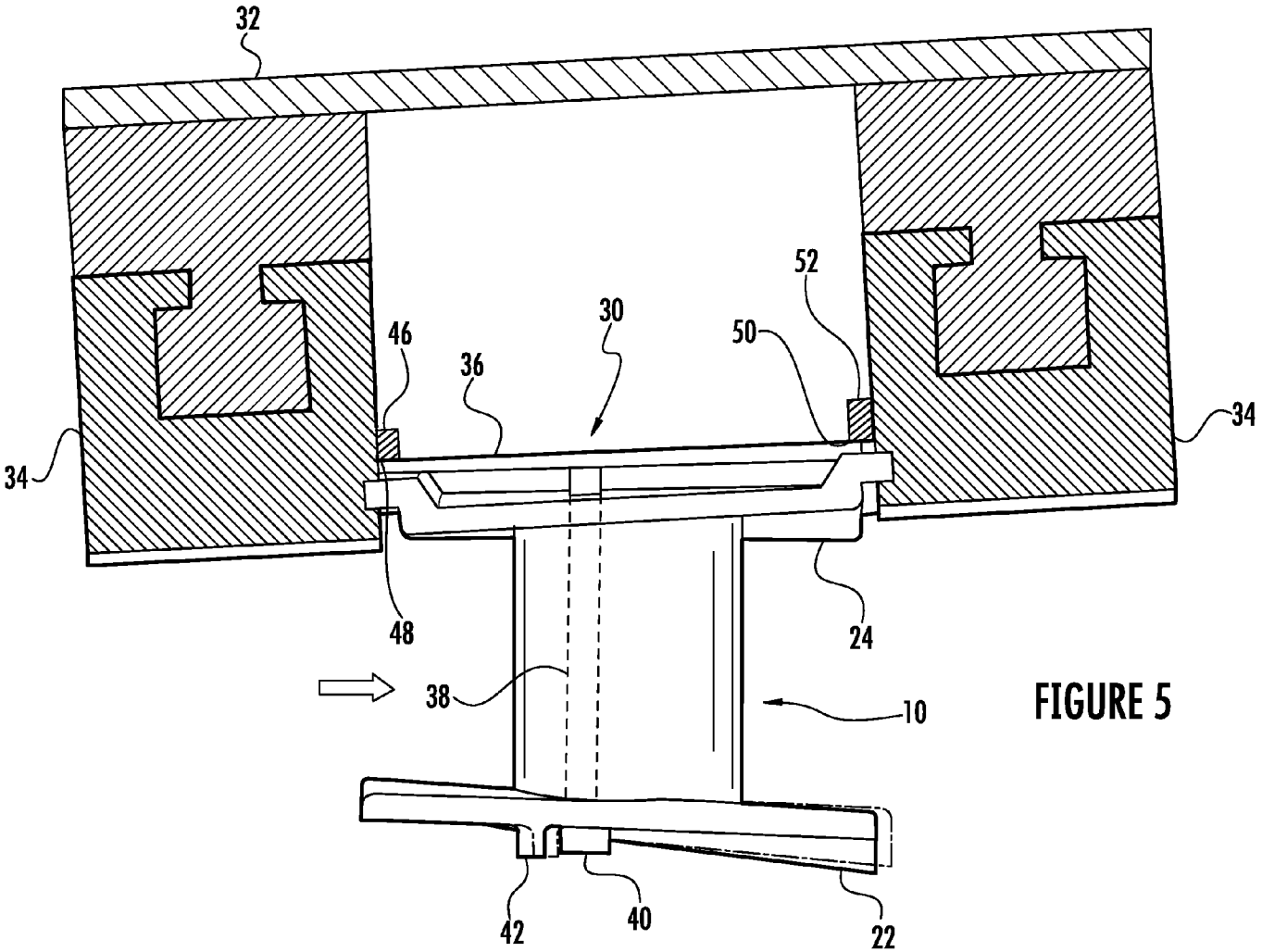
FIG. 5 is a side view of a system for supporting a nozzle assembly according to a fourth embodiment of the present invention.

FIG. 5 provides a side view of the system for supporting the nozzle assembly 10 shown in FIG. 1 according to yet another embodiment of the present invention. In this particular embodiment, the first and second detents 46, 52 connect the first and second ends 48, 50 of the first member 36 to the shroud 34 or other stationary component. As the effects of creep tend to force the inner sidewall 22 of the nozzle assembly 10 to the right, as shown in FIG. 5, the land 42 on the inner sidewall 22 of the nozzle assembly 10 moves to the right until it abuts or contacts with the distal end 40 of the second member 38. At that point, the distal end 40 of the second member 38 transfers the force applied by the land 42 through the support 30 to the first and second detents 46, 52. The first and second detents 46, 52 prevent or limit movement of the support 30 which in turn prevents or limits further movement of the inner sidewall 22.

The various embodiments shown in FIGS. 2-5 may also be used to provide a method for supporting the nozzle assembly 10. The method generally includes connecting the first member 36 to the stationary component, such as the casing 32 or shroud 34. The method further includes extending the second member 38 inward from the first member 36 radially through at least a portion of the nozzle assembly 10 and contacting the distal end 40 of the second member 38 to the nozzle assembly 10. In particular embodiments, the method may further include aligning the first member 36 approximately perpendicular to or parallel to the second member 38. In addition, the method may include slidingly connecting the second end 50 of said first member 38 to the stationary component and contacting the second end 50 of said first member 38 with the second detent 52 to limit movement of the second end 50.

The various embodiments described and illustrated with respect to FIGS. 2-5 provide several advantages over existing techniques to limit or prevent the effects of creep. For example, the reinforcement provided by the support 30 to the nozzle assembly 10 allows the nozzle assembly 10 to be exposed to higher temperatures without increasing the amount of creep produced in the nozzle assembly 10. Alternately, or in addition, the nozzle assembly 10 may be manufactured using less expensive materials that no are longer required to withstand the effects of creep. Moreover, the support 30 may allow the axial length of the nozzle assembly 10 to be reduced, reducing the overall length of the turbine or compressor.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A system for supporting a nozzle assembly, comprising:

a first member connected to a stationary component, wherein said first member comprises a first end fixedly connected to the stationary component and a second end axially displaced from said first end, wherein said second end and may move with respect to the stationary component;

a second member extending from said first member radially through at least a portion of the nozzle assembly; and a distal end of said second member radially displaced from said first member and configured to contact the nozzle assembly.

2. The system as in claim 1, wherein said first member is connected to at least one of a shroud or a casing.

3. The system as in claim 1, wherein said first member is aligned approximately perpendicular to said second member.

4. The system as in claim 1, wherein said first member is aligned approximately parallel to said second member.

5. The system as in claim 1, further comprising a detent proximate to said second end, wherein said detent is configured to contact said second end to limit movement of said second end.

6. The system as in claim 1, wherein at least one of said first member or said second member comprises a cylinder.

7. A system for supporting a nozzle assembly, comprising:

a support, wherein at least a portion of said support extends radially through at least a portion of the nozzle assembly and contacts the nozzle assembly, wherein said support comprises a first member and a second member extending from said first member radially through the nozzle assembly, wherein said first member comprises a first end fixedly connected to the stationary component and a second end axially displaced from said first end, wherein said second end and may move with respect to the stationary component; and means for connecting at least a portion of said support to a stationary component proximate to the nozzle assembly.

8. The system as in claim 7, wherein said means connects at least a portion of said support to at least one of a shroud or casing.

9. The system as in claim 7, wherein said first member is aligned approximately perpendicular to said second member.

10. The system as in claim 7, wherein said first member is aligned approximately parallel to said second member.

11. The system as in claim 7, wherein at least one of said first member or said second member comprises a cylinder.

12. The system as in claim 7, further comprising a detent proximate to said second end, wherein said detent is configured to contact said second end to limit movement of said second end.

13. A method for supporting a nozzle assembly, comprising:

connecting a first member to a stationary component;

fixedly connecting a first end of said first member to the stationary component and slidingly connecting a second end of said first member to the stationary component, wherein said second end of said first member is axially displaced from said first end;

extending a second member from said first member radially through at least a portion of the nozzle assembly; and contacting a distal end of said second member to the nozzle assembly, wherein said distal end is radially displaced from said first member.

14. The method as in claim 13, further comprising fixedly connecting said first member to at least one of a shroud or a casing.

15. The method as in claim 13, further comprising aligning said first member approximately perpendicular to said second member.

16. The method as in claim 13, further comprising contacting said second end of said first member with a detent proximate to said second end, wherein said detent is configured to contact said second end to limit movement of said second end.

* * * * *